US010774835B2

(12) United States Patent
Geue et al.

(10) Patent No.: US 10,774,835 B2
(45) Date of Patent: Sep. 15, 2020

(54) VACUUM PUMP WITH SOUND ABSORPTION AND CHECK VALVE

(71) Applicant: Hella GmbH & Co. KGaA, Lippstadt (DE)

(72) Inventors: Ingo Geue, Bad Sassendorf (DE); Theodor Hüser, Geseke (DE); Christian Praest, Langenberg (DE); Thomas Valeiras Fernandez, Lippstadt (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 295 days.

(21) Appl. No.: 15/778,119

(22) PCT Filed: Nov. 14, 2016

(86) PCT No.: PCT/EP2016/077550
§ 371 (c)(1),
(2) Date: May 22, 2018

(87) PCT Pub. No.: WO2017/089156
PCT Pub. Date: Jun. 1, 2017

(65) Prior Publication Data

US 2018/0335034 A1 Nov. 22, 2018

(30) Foreign Application Priority Data

Nov. 24, 2015 (DE) ..... 10 2015 120 304

(51) Int. Cl.
*F04C 29/06* (2006.01)
*F04C 25/02* (2006.01)
(Continued)

(52) U.S. Cl.
CPC ..... *F04C 29/065* (2013.01); *F04C 18/344* (2013.01); *F04C 25/02* (2013.01);
(Continued)

(58) Field of Classification Search
CPC .. F04C 2240/30; F04C 29/065; F04C 29/066; F04C 29/068; F04C 29/126
See application file for complete search history.

(56) References Cited

U.S. PATENT DOCUMENTS 6,132,183 A * 10/2000 Li ..... F04C 29/066 248/638
8,500,417 B2 * 8/2013 Han ..... F04B 37/14 181/229

(Continued)

FOREIGN PATENT DOCUMENTS

DE 3335427 A1 4/1984
DE 102012112069 A1 6/2014

(Continued)

*Primary Examiner* — Mary Davis
(74) *Attorney, Agent, or Firm* — Husch Blackwell LLP

(57) ABSTRACT

A vacuum pump with a primarily cylinder-shaped pump housing is provided. A bowl-shaped sound-absorbing cover is attached on the pump housing and a circumferential gap space for sound absorption is formed between the pump housing and the sound-absorbing cover. The pump housing has an end face in which at least one air outlet opening is arranged. An elastic upstream sound absorber element is arranged between the end face and the sound-absorbing cover so that an upstream chamber is formed therebetween into which the air flows from the air outlet opening. The upstream sound absorber element has a molded projection facing the end face with an air channel passing through the projection. The projection is arranged at a distance from the end face during operation of the vacuum pump. While the vacuum pump is idle, the projection makes contact with the end face through elastic deformation of the upstream sound absorber element, causing the air channel to be closed off and creating a check valve function.

8 Claims, 2 Drawing Sheets

(51) Int. Cl.
*F04C 18/344* (2006.01)
*F04C 29/12* (2006.01)

(52) U.S. Cl.
CPC ..... *F04C 29/066* (2013.01); *F04C 29/068* (2013.01); *F04C 29/126* (2013.01); *F04C 2220/10* (2013.01); *F04C 2240/30* (2013.01)

(56) References Cited

U.S. PATENT DOCUMENTS

| | | | | |
|---|---|---|---|---|
| 9,429,159 | B2 * | 8/2016 | Geue | F04C 29/066 |
| 9,845,681 | B2 * | 12/2017 | Ziehr | F04C 29/065 |
| 2010/0319798 | A1 | 12/2010 | Lim et al. | |
| 2013/0045126 | A1 | 2/2013 | Huser et al. | |

FOREIGN PATENT DOCUMENTS

| | | | |
|---|---|---|---|
| DE | 102012112465 | A1 | 6/2014 |
| DE | 102013104375 | A1 | 10/2014 |
| WO | 2014075660 | A2 | 5/2014 |

* cited by examiner

VACUUM PUMP WITH SOUND ABSORPTION AND CHECK VALVE

CROSS REFERENCE

This application claims priority to PCT Application No. PCT/EP2016/077550, filed Nov. 14, 2016, which itself claims priority to German Patent Application 10 2015 120304.9, filed Nov. 24, 2015, the entirety of both of which are hereby incorporated by reference.

FIELD OF THE INVENTION

The preset invention pertains to a vacuum pump with a primarily cylinder-shaped pump housing, in which a rotor with slider elements is mounted to swivel, and having at least one air outlet opening, where a bowl-shaped sound-absorbing cover is attached on the pump housing and where a circumferential gap space for sound absorption is formed between the pump housing and the sound-absorbing cover and where the pump housing has an end face in which at least one air outlet opening is arranged and where an elastic upstream sound absorber element is arranged between the end face and the sound-absorbing cover so that an upstream chamber is formed between the upstream sound absorber element and the end face into which the air flows from the air outlet opening.

BACKGROUND

DE 10 2012 112 069 A1 discloses a category-defining vacuum pump, and an upstream sound-absorbing element made of a rubber-elastic material is installed between a bowl-shaped sound-absorbing cover and a pump housing. The air that escapes from the air outlet opening in the front side of the pump housing flows through a filter housed in the upstream sound-absorber element. The further course of the air flow goes between the sound-absorbing cover and the upstream sound absorber element until the air finally enters a circumferential gap space between the outside of the primarily cylinder-shaped pump housing and the sound-absorbing cover.

Vacuum pumps of this type are, in themselves, known and are also called vane pumps, and the vacuum pump also has a motor attached to the pump housing that initiates the rotation of the rotor with the slider elements. The sound absorber is necessary to prevent potential sound emissions when operating the vacuum pump. Vacuum pumps of the type of interest here are used to generate low pressure for the purpose of engine management or for brake force boost in a vehicle. In doing so, it is desirable for the vacuum pump to operate with as little noise as possible.

It is also known that in vacuum pumps of this type, when at a standstill, the conveyed air is sucked back from the upstream chamber into the pump housing through the air outlet opening. In the process, dirt, dust, suspended particles and the like can get into the pump housing, potentially resulting in premature failure of the vacuum pump. Therefore, a filter is used in the upstream sound absorber element, and the filter prevents dirt from entering the air outlet opening when the vacuum pump is idle. A disadvantage is that the filter forms a flow resistance, and moreover, there is an effect that separated substances in the filter can be flushed out of the filter, then return to the air outlet opening and thus to the pump housing.

SUMMARY OF THE INVENTION

The task of the invention is forming a vacuum pump with an advantageous sound absorber, which is also intended to prevent dirt from entering the air outlet opening when the pump is idle. The intention is to avoid the need to use a filter.

The invention includes the technical contribution that the upstream sound absorber element has a molded projection facing the end face with an air channel passing through the projection, where the projection is arranged at a distance from the end face during operation of the vacuum pump and, while the vacuum pump is idle, the projection makes contact with the end face through elastic deformation of the upstream sound absorber element, causing the air channel to be closed off and creating a check valve function.

The inventive solution attains a method whereby without the use of a filter, dirt is prevented from entering the air outlet opening and thus the pump housing. As soon as the vacuum pump is shut off, there is an immediate low pressure in the upstream chamber, which causes an elastic deformation of the upstream sound absorber element such that the projection reaches the end face on the top of the pump housing. The mouth of the air channel in the end-face area of the projection seals off the air channel, and the prevailing low pressure in the upstream chamber holds the projection against the end face, causing the air channel to remain closed. This function of the check valve effectively prevents air from the area in or under the sound-absorbing hood from getting back into the air outlet opening and thus into the pump housing. Only a small volume of the upstream chamber is sucked back into the air outlet opening by the low pressure that forms, until the projection makes contact with the end face and seals off the air channel. As soon as the vacuum pump is placed back into operation, the upstream chamber is again pressurized and the projection lifts back off from the end face of the pump housing and the air channel in the projection is cleared. As a result, the vacuum pump can continue to be used under normal operating conditions.

For example, the upstream sound absorber element has a diaphragm section in which the projection with the air channel is held, particularly in the center. In accordance with an advantageous embodiment, the upstream sound absorber element is shaped like a circular disk and has an outer ring section used to hold the upstream sound absorber element between the sound-absorbing cover and the end face of the pump housing. Thus the projection with the air channel in the center is located in the upstream sound absorber element, and the diaphragm section extends in the shape of a circular disc around the central projection with air channel. In this design, the upstream sound absorber element is advantageously designed as one piece, causing the projection to cross over into the diaphragm section in one piece.

The upstream sound absorber element also provides the additional advantage of a ring section and the diaphragm section is advantageously formed between the projection and the ring section. As such, the ring section can stabilize the upstream sound absorber element, and the projection can move axially relative to the ring section like a speaker over the diaphragm section. The ring section also provides an advantage of crossing over into the diaphragm section as one piece and the ring section is also made of an elastic rubber material.

As another advantage, ribs are formed on the inside in the sound-absorbing cover; the upstream sound absorber element comes to rest against these ribs at least with the diaphragm section if the vacuum pump is in operation. The ribs prevent the diaphragm section from creating a seal in the path of airflow because the diaphragm section cannot come into contact with the inside of the sound-absorbing cover.

As another advantage, a sealing lip is radially attached to the outside of the ring section and the lip is in contact with a circumferential ridge in the sound-absorbing cover. The design of the sealing lip forms another sound-absorbing space that is fluidly connected by a flow constriction to the ribbed chamber where the ribs are arranged.

As another advantage, a circumferential holder ridge is formed in the sound-absorbing cover with the ring section of the upstream sound absorber element being held by that ridge. A flow constriction can also be provided in the holder ridge in the effective connection with the ring section, causing the air to pass through this flow constriction when it goes from the ribbed chamber into an intermediate space formed in the area above the sealing lip.

Another advantage is that the air channel in the projection has a cross-section that is dimensioned with such a small size that an air-regulating effect is created when air flows through the air channel between the upstream chamber and a ribbed chamber formed between the upstream sound absorber element and the sound-absorbing cover.

The advantage from the inventive sound damping of the vacuum pump results from combining the sound-absorbing action with the function of a check valve. Another advantage stems from the several successively formed air regulating chambers, which are each achieved through flow constrictions and are arranged in the flow path in sequence. This achieves a particularly effective sound-damping effect.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

Figure 1:
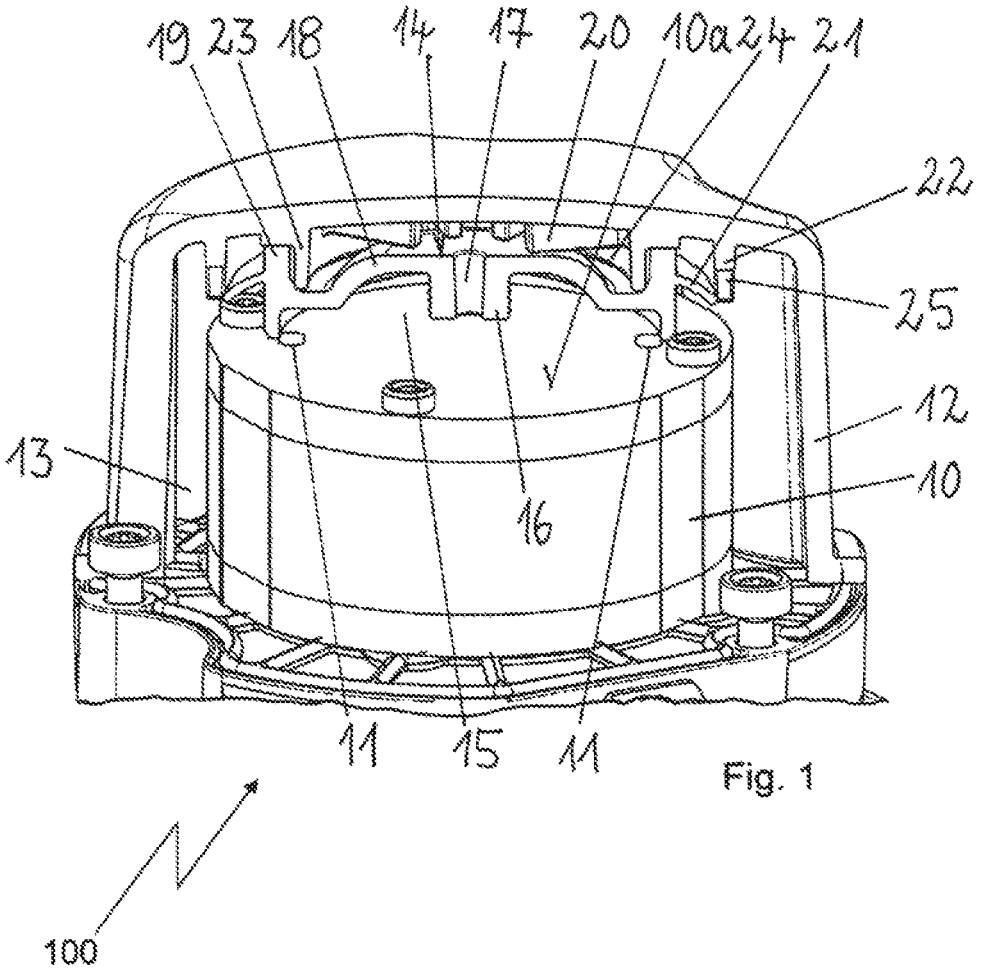
FIG. 1 is a perspective view of a vacuum pump with a cross-sectional sound-absorbing cover and a cross-sectional upstream sound absorber element.

FIG. 1 shows a vacuum pump 100 with a primarily cylindrical pump housing 10, in which a rotor with slider elements is mounted to swivel, where the vacuum pump also has an electric motor connected on the bottom of the pump housing 10 but not described in greater detail here.

The pump housing 10 has a primarily cylindrical design and has an end face 10*a* at the top and two air outlet openings 11 are shown in the end face 10*a* as an example.

The cylindrical pump housing 10 is surrounded by a sound-absorbing cover 12, and the air that flows out of the air outlet openings 11 goes into a gap space 13 formed all the way around between the cylindrical pump housing 10 and the bowl-shaped sound-absorbing cover 12.

In the area above the pump housing 10 between the end face 10*a* and the bottom area of the bowl-shaped sound-absorbing cover 12, an upstream sound absorber element 14 made of an elastic rubber material is inserted. An upstream chamber 15 is formed between the end face 10*a* and the upstream sound absorber element 14; the air from the air outlet openings 11 initially flows into this chamber to work together with the upstream sound absorber element 14 as described below.

If the vacuum pump 100 is taken out of operation, air flows out of the air outlet openings 11 into the upstream chamber 15. The upstream chamber 15 is bounded radially on the outside by an outer ring section 19 of the upstream sound absorber element 14 tensioned between a holder ridge 23 of the sound-absorbing cover 12 and the end face 10*a* of the pump housing 10. In this configuration, ring section 19 forms a seal on the end face 10*a*. Through the sealing effect, the air entering into the upstream chamber 15 from the air outlet openings 11 goes through an air channel 17, which is installed in a central projection 16 in the upstream sound absorber element 14. Once the air has passed through the air channel 17, it goes into a ribbed chamber 24 formed between the upstream sound absorber element 14 and the bottom area of the bowl-shaped sound-absorbing cover 12.

In the ribbed chamber 14, several ribs 20 extend outwards radially and the ribs 20 are on the inside. Sound-absorbing cover 12 arranged. The elastic rubber upstream sound absorber element 14 is at the front sides of the ribs 20 during vacuum pump 100 operation, allowing the air to flow outward radially between the ribs 20.

Cavities are provided between the ring section 19 and the holder ridge 23 at two points provided as examples and not shown in greater detail here; this allows the air to go into an intermediate space sealed against another ridge 22 by a sealing lip 21. The ridge 22 is arranged on the inside of the sound-absorbing cover 12 and has several slits 25 in its circumference, allowing the air to ultimately go through the slits 25 into the gap space 13.

The upstream sound absorber element 14 has a diaphragm section 18 that extends between the projection 16 and the ring section 19. If the vacuum pump 100 is taken out of operation, low pressure is abruptly created in the upstream chamber 15 because air is sucked back into the pump housing 10 through the air outlet openings 11. The projection 16 moves against the end face 10*a* and comes to rest against it. The air channel 17 is subsequently sealed and no air can flow back into the air outlet openings 11. This function forms a check valve and the projection 16 does not lift off of the end face 10*a* and uncover the air channel 17 until the vacuum pump 100 has resumed operation. The check valve function created in this way prevents the ingress of dirt into the air outlet openings 11 because no contaminated air can flow back into the upstream chamber 15 due to the sealed air channel 17. This advantageous embodiment of the upstream sound absorber element 14 eliminates the need for the placement of a filter, allowing a reduction in flow resistance for the outflow of air out of the air outlet openings 11 due to the elimination of the filter.

Figure 2:
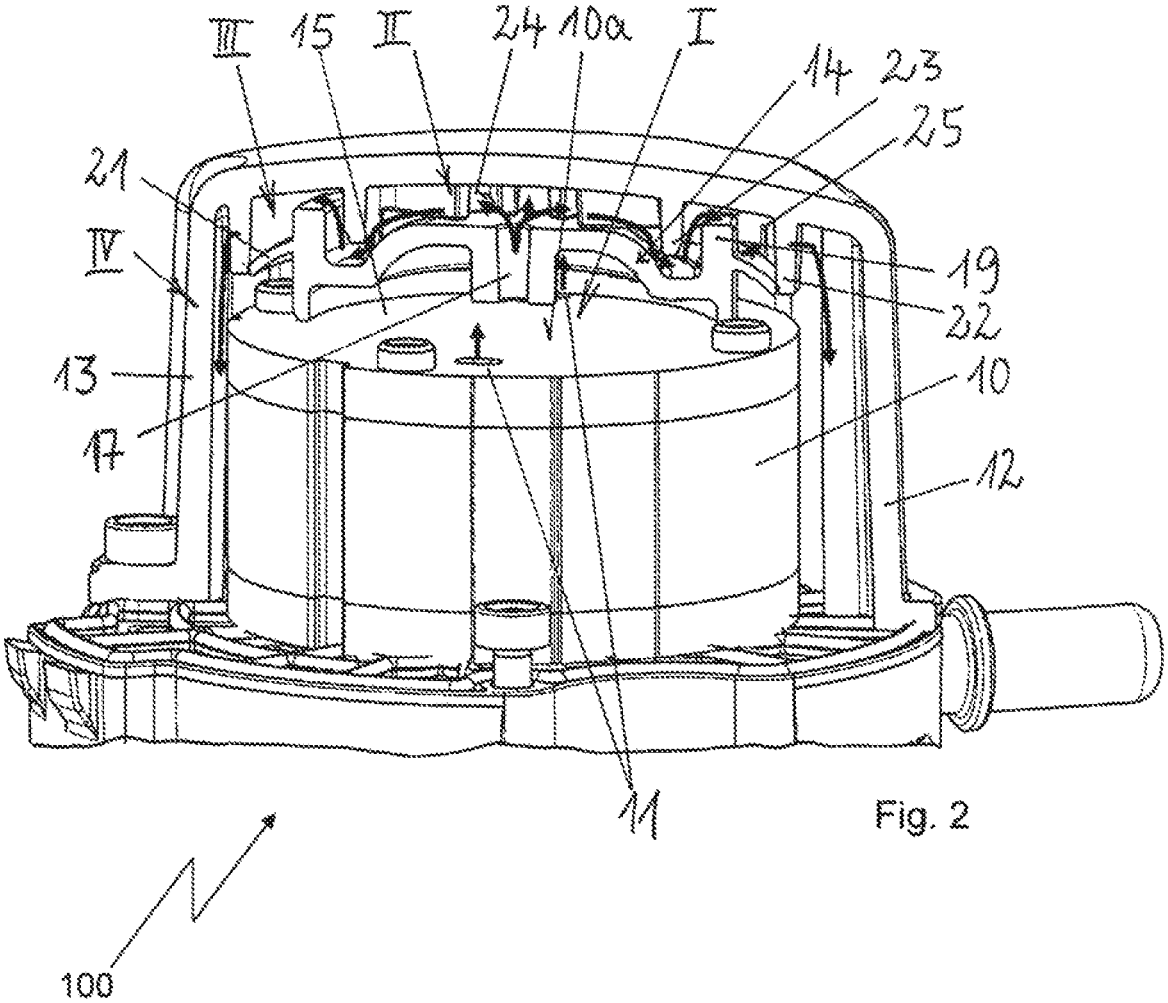
FIG. 2 is a view of the vacuum pump in accordance with FIG. 1, where the air flow path is shown indicating how the air flows through and around the upstream sound absorber element.

FIG. 2 shows the vacuum pump 100 with the pump housing 10 and with the sound-absorbing cover 12 shown in cross-section; arrows are used to indicate the flow paths taken by the air out of the air outlet openings 11 to go into the gap space 13.

The upstream chamber 15 forms an initial air regulating chamber II into which the air flows from the air outlet openings 11, as indicated by the arrows. Subsequently, the air goes through the air channel 17 into a second air regulating chamber II formed by the ribbed chamber 24.

The cross-section provides a view of a cavity between the ring section 19 and the holder ridge 23; it shows that the air flows into another air regulating chamber III from the ribbed chamber 24, with the air regulating chamber being bounded on the bottom by a sealing lip 21.

Due to several slits 25 distributed around the circumference of the additional ridge 22, the air ultimately goes into a circumferential gap space 13, which forms another, final air regulating chamber IV.

The formation of several air regulating chambers I-IV arranged in succession, each with its own choke crosssections between air regulating chambers I-IV, achieves especially advantageous sound dampening.

The design of the invention is not limited to the preferred embodiment specified here. Rather, a number of variants are conceivable, which make use of the present solution also in designs of a fundamentally different type. All of the features and/or advantages arising from the claims, description or drawings, including design details, physical layout and process steps, may be vital to the invention both by themselves and in a wide variety of combinations.

REFERENCE NUMERAL LIST

100 Vacuum pump
10 Pump housing
10*a* End face
11 Air outlet opening
12 Sound-absorbing cover
13 Gap space
14 Upstream sound absorber element
15 Upstream chamber
16 Projection
17 Air channel
18 Diaphragm section
19 Ring section
20 Rib
21 Sealing lip
22 Ridge
23 Holder ridge
24 Ribbed chamber
25 Slit
I Air regulating chamber
II Air regulating chamber
III Air regulating chamber
IV Air regulating chamber

The invention claimed is:

1. A vacuum pump comprising:

a primarily cylinder-shaped pump housing, in which a rotor with slider elements is mounted to swivel;

at least one air outlet opening, wherein the pump housing including an end face in which at least one said air outlet opening is arranged;

a bowl-shaped sound-absorbing cover is attached on the pump housing;

a circumferential gap space for sound absorption formed between the pump housing and the sound-absorbing cover an elastic upstream sound absorber element arranged between the end face and the sound-absorbing cover so that an upstream chamber is formed between the upstream sound absorber element and the end face into which the air flows from the air outlet opening, wherein the upstream sound absorber element has a molded projection facing the end face with an air channel passing through the projection;

wherein the projection is arranged at a distance from the end face during operation of the vacuum pump and, while the vacuum pump is idle, the projection makes contact with the end face through elastic deformation of the upstream sound absorber element, causing the air channel to be closed off and creating a check valve function.

2. The vacuum pump in accordance with claim 1, wherein the upstream sound absorber element has a diaphragm section containing the projection with the air channel.

3. The vacuum pump in accordance with claim 2, wherein the upstream sound absorber element is shaped like a circular disk and has an outer ring section used to hold the upstream sound absorber element between the sound-absorbing cover and the end face of the pump housing.

4. The vacuum pump in accordance with claim 3, wherein the diaphragm section is formed between the projection and the ring section, where the projection is formed in the center of the circular disk shape of the upstream sound absorber element.

5. The vacuum pump in accordance with claim 3, wherein a sealing lip is radially attached to the outside of the ring section, which is in contact with a circumferential ridge in the sound-absorbing cover.

6. The vacuum pump in accordance with claim 3, wherein a circumferential holder ridge is formed in the sound-absorbing cover and holds the ring section of the upstream sound absorber element.

7. The vacuum pump in accordance with claim 2, wherein inside the sound-absorbing cover, ribs are formed against which the upstream sound absorber element comes to rest at least with the diaphragm section if the vacuum pump is in operation.

8. The vacuum pump in accordance with claim 1, wherein the air channel in the projection has a cross-section that is dimensioned with such a small size that an air-regulating effect is created when air flows through the air channel between the upstream chamber and a ribbed chamber formed between the upstream sound absorber element and the sound-absorbing cover.

* * * * *